US006877687B2

(12) United States Patent
Moon et al.

(10) Patent No.: US 6,877,687 B2
(45) Date of Patent: Apr. 12, 2005

(54) DIRECT CURRENT POWERED HOSE REWINDING APPARATUS

(75) Inventors: Brian Moon, Dekalb, IL (US); Lyle A. Rosine, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 51 days.

(21) Appl. No.: 10/346,908

(22) Filed: Jan. 17, 2003

(65) Prior Publication Data

US 2003/0213865 A1 Nov. 20, 2003

Related U.S. Application Data

(63) Continuation-in-part of application No. 29/154,133, filed on Jan. 18, 2002, now abandoned.

(51) Int. Cl.[7] ..... B65H 75/30; B65H 75/40

(52) U.S. Cl. ..... 242/390.8; 242/395; 242/406; 137/355.2; 137/355.27

(58) Field of Search ..... 242/390.8, 390.9, 242/395, 395.1, 406; 137/355.12, 355.2, 355.26, 355.27

(56) References Cited

U.S. PATENT DOCUMENTS 2,301,208 A * 11/1942 Gear ..... 242/390.8
2,573,868 A * 11/1951 Newell ..... 137/355.21
2,606,067 A * 8/1952 Roark ..... 137/355.17
2,893,656 A * 7/1959 Carlson ..... 242/395.1
3,315,914 A * 4/1967 Turner ..... 242/390.8
3,910,524 A * 10/1975 Ireland ..... 242/390.8
4,012,002 A 3/1977 McDonald et al.
4,431,144 A * 2/1984 Foster ..... 242/406
4,513,772 A 4/1985 Fisher
4,832,074 A 5/1989 Li
4,893,037 A * 1/1990 Schwartz ..... 242/390.9
5,495,995 A 3/1996 Dominique et al.
6,149,096 A 11/2000 Hartley
6,533,210 B1 * 3/2003 Berke et al. ..... 242/390.8
6,591,858 B2 * 7/2003 Peterson ..... 137/355.23
2002/0014551 A1 * 2/2002 Tuttlebee ..... 242/390.8

* cited by examiner

*Primary Examiner*—John M. Jillions
(74) *Attorney, Agent, or Firm*—McHale & Slavin, P.A.

(57) ABSTRACT

A direct current powered hose rewinding apparatus for use with an associated flexible hose includes a removable, replaceable, and rechargeable battery assembly for motorized rewinding of the hose. The reel is carried by and enclosed within an enclosure and is rotatable by either a direct current powered motor or a folding manual crank. Power from the electrical motor is transferred to the reel via an infinitely adjustable torque transfer assembly. The enclosure has left and right wall panels, front and rear wall panels extending between the left and right wall panels, and a cover. When the cover is in the open position, the direct current motor is operationally locked out, and when the cover is rotated into the closed position, the direct current motor is operable.

47 Claims, 14 Drawing Sheets

DIRECT CURRENT POWERED HOSE REWINDING APPARATUS

CROSS REFERENCE TO RELATED APPLICATIONS

This application is a continuation-in-part of applicant's U.S. application Ser. No. 29/154,133 filed Jan. 18, 2002 now abandoned, the contents of which are hereby incorporated by reference.

FIELD OF THE INVENTION

This invention is directed to a hose reel for flexible hoses. More specifically, the present invention relates to an electrically powered, motor driven hose reel with manual override that is mounted within a protective safety enclosure.

BACKGROUND OF THE INVENTION

Garden hoses are a necessity for lawn and garden care, as well as general all-around home care. Typically, hoses are found either wound and left on the ground near a water spigot, or wound on one of many known hose reel-type storage devices. During the off-season, hoses are often found on the floor of a garage or other storage area.

The prior art has proposed a number of different structures for rewinding and storing a hose when it is not in use. These devices generally include stationary hose reel hangers that can be mounted to a surface of a building, such as an outer wall of a house or portable hose reel carts that permit ready transport of the hose from one location to another.

In the past, it was common to retrieve hoses and the like by manually winding them around a suitable structure such as a wall mounted hanger or simply bundling them into loose coils. Surface (or wall) mounted hose reels or hangers come in a wide variety of configurations. For example, one surface mounted hose hanger includes a simple, semi-circular metal or plastic support that is mounted to the building, over which the hose is looped or hung. Another surface mounted device or reel includes a rotatable fitting that is mounted to the building surface to which a manually rotated reel is mounted. Unfortunately, when hose is pulled out from such manually wound devices, it often becomes snarled or tangled and requires appreciable time and effort to correct the situation. Additionally, these surface mounted reels and hangers are often considered unsightly, particularly if they are mounted to the front of the building and are not covered or otherwise obscured by plants or foliage.

Portable hose reel carts permit ready transport of the hose from one location to another. Portable hose reel carts typically include an open, manually rotatable reel or spool positioned between a pair of side frames with wheels. The hose is manually wound upon the reel for storage and pulled or dispensed from the reel for use.

Although such carts have become wide-spread in use because of their portable storage capabilities, they do have drawbacks. First, these devices require manual winding of the hose. Rewinding long hoses requires a considerable effort. Due to the low positional location of the winding mechanism on these devices, many users may be physically unable to complete the rewinding. Additionally, a hose stored on such a reel is exposed to the elements. Often hoses are made of rubber or like materials that can become stiff or brittle and can break when subjected to ultra-violet radiation or low temperature extremes, particularly with advanced age.

Portable hose reel carts may also be considered by some to be unsightly. Given that most hose reel carts are designed for use in and around garden and lawn areas, it is expected and natural for these carts to become dirty. As such, some users may be inclined to constantly remove a hose reel cart, particularly from the front of a house. When, for example, the cart becomes dirty, muddy or discolored.

In an effort to solve some of these problems, a number of hose retrieval devices have been developed which automatically retrieve and rewind hose on a reel in such a manner so as to avoid tangling the next time the hose is deployed or paid out. Such devices generally include a reel and a level wind mechanism for guiding the hose onto the reel. The level wind mechanism includes a traversing screw, a guide rod, and a follower. The reel is generally directly driven by a motor and/or an intermeshing clutch assembly. Unfortunately, the electric motors of the prior art devices have voltage requirements that reduce portability and increase the risk of electrical shock. Additionally, the clutch mechanisms utilized on these devices are either completely engaged or completely disengaged and lack an infinitely adjustable torque transfer assembly to allow operator controlled speed and/or force of hose retrieval.

Unfortunately, many of these motorized devices also lack a suitably safe enclosure to protect the operator and/or small children from being accidentally caught in the device. For example, none of the motorized hose reels known are equipped with safety interlocks to prevent the motor from being engaged if an enclosure cover is opened. To compound the problem, many of these devices do not provide for an emergency stop and require the entire hose to be retracted before the device can be stopped. Retracting the entire hose may take several seconds and exacerbates emergency situations such as when a person or pet has been caught in the machine or in the hose as it is retracted. In addition, none of the devices known provide a disengaging hose winding guide. The level winds of the prior art are capable of causing severe damage to an operator, child or pet that may accidentally get caught in the rewinding device.

Accordingly, there exists a need for a rechargeable battery operated motorized hose reel storage device that permits safe motorized take-up and manual dispensing of a hose that is also aesthetically pleasing. Such a hose reel storage device that can be safely used to retract and "hide-away" the hoses stored therein when not in use, and desirably provides a protective, outwardly aesthetically pleasing appearance.

DESCRIPTION OF THE PRIOR ART

A number of reel assemblies utilizing electric motors to drive a reel for retracting an elongate member such as a cord or hose have been disclosed. Examples are disclosed as follows:

U.S. Pat. No. 4,832,074 discloses an automatic hose rewinding device having an alternating current (AC) motor driven reel. The desired amount of hose is pulled out of the enclosure manually for use. After use a button is pushed once and the hose is completely retracted until a device on the end of the hose strikes a bar to disengage the AC motor. The design of the device does not allow small increments of the hose to be retracted. If the operator wishes to use a smaller amount of hose, the entire hose must be retracted and the desired amount of hose must be manually pulled out again. Additionally, the use of alternating current reduces portability of the device and increases the risk of electrical shock.

U.S. Pat. No. 4,513,772 discloses an automatic hose winding apparatus having an intermeshing, non-slipping clutch. The desired amount of hose is pulled out of the enclosure manually for use. For retraction, the operator must manually lock the intermeshing clutch mechanism in place. When the hose is completely retracted a device on the end of the hose strikes a lever to disengage the intermeshing clutch. The design of the device allows increments of the hose to be retracted, however, the operator must manually disengage the clutch before any amount of hose can be manually payed out. The apparatus makes no disclosure or suggestion of a protective enclosure or a disengaging hose guide.

U.S. Pat. No. 5,495,995 discloses a motor driven hose reel assembly. The device interconnects two sensors and a motor to monitor the quantity of hose manually pulled from the reel. By pulling on the hose manually, the hose is rewound in an amount less than that necessary to completely rewind the hose. Because the device is operated in a retraction direction when the hose is pulled, the design requires the operator to overcome the pulling force of the device to extend hose from the machine.

U.S. Pat. No. 4,012,002 discloses a coupling mechanism for use in conjunction with a hose reel to automatically and selectively engage or disengage the reel and motorized drive train. The coupling utilizes a sliding spring pin on the drive train which is designed to automatically engage one of a series of cooperating stop lugs on the reel to transmit the driving power of the motor to the rotatable reel. The spring pin can be manually locked in a disengaged position to allow the hose reel to freewheel. When the spring pin is engaged the device operates in direct drive from the motor.

U.S. Pat. No. 6,149,096 discloses a retractable reel device especially useful for electrical cables. The device is specifically designed to allow an operator to pull out a desired amount of cable. Once the cable is paid out, the device maintains a predetermined amount of tension on the cable. Thereafter, any slack in the cable is automatically retracted by an AC motor.

The prior art devices fail to teach or suggest the use of an infinitely adjustable torque transfer method for modulating hose retrieval. The references are further deficient in teaching the use of a rechargeable battery in combination with a direct current (DC) motor for powering the hose retrieval device. Moreover, the references are deficient in teaching an enclosure with safety interlocks that prevent the motor from being engaged when a cover is in an open position. The devices are further deficient in teaching a safety hose guide assembly that is capable of disengagement in the event that the path of the device is inadvertently blocked. The prior art devices are still yet deficient in teaching a motorized hose with manual override, allowing the hose to be retracted manually as well as by motor.

SUMMARY OF THE INVENTION

The instant invention relates to a direct current powered hose rewinding reel for use with an associated flexible hose. The apparatus includes a motorized rotatable reel carried and contained within an enclosure. The rotatable reel includes a hub and a pair of flanges at opposing ends of the hub, and is configured for storage, motorized take-up, and manual pay-out of the flexible hose. Power for the motorized reel is supplied through a control assembly that includes a rechargeable battery, a main power switch, and at least one safety interlock. The safety interlock(s) are incorporated into the enclosure and prevent motorized operation of the reel when the enclosure is opened.

The enclosure has left and right side wall panels, front and rear wall panels extending between the left and right wall panels, and a cover. The enclosure is configured for receiving a rotatable reel for storing a length of flexible hose within the enclosure.

The cover pivots about a pair of hinges that mount the cover to the enclosure for movement between a closed position and an open position. Each hinge includes a pocket formed in a respective side wall panel and a pin associated and cooperative with each pocket. The cover can be formed having a depending lip, and the pins can extend from the lip. Preferably, the pins are formed as fluted cylindrical elements extending from the lip, axially aligned to one another to facilitate rotational movement.

When the cover is rotated into the open position, a safety interlock switch assembly prevents motorized operation of the hose reel. When the cover is rotated into the closed position, an engagement pin extending from the underside of the cover cooperates with the safety interlock switch to allow motorized operation of the hose reel.

To facilitate take-up and pay-out of the hose with the cover closed, the front wall panel includes a cut-out portion extending downward from the top edge thereof adjacent to the junction with the cover. In this arrangement, when the cover is closed, the cut-out accommodates traversing a portion of the flexible hose therethrough.

In one embodiment a reciprocating hose guide assembly is linked to the hose reel. When the hose reel is rotated, the reciprocating hose guide will move back and forth across the reel to uniformly and smoothly wrap the hose on the reel to provide a compact storage configuration.

In a further embodiment, the reciprocating hose guide can be released from its double-helix lead-screw in the event that its path becomes blocked, such as by debris or when a hand or arm is mistakenly placed in the opening. Alternatively, the hose guide may be manually disengaged to facilitate easy hose pay-out and can thereafter be repositioned before being manually re-engaged.

A sliding seal fluid inlet joint permits the hose outlet joint to rotate with the hose reel without disconnecting the hose. This arrangement permits rotating the spool without twisting or torquing internal components, while maintaining sealed fluid communication between the water supply and the hose.

For motorized operation the hose reel is provided with a winding means capable of rotational movement of the reel in relation to the enclosure and an electrically energized power assist means for selective and operative engagement of the winding means. The winding means and power assist means are illustrated by a DC powered motor mounted to the enclosure and connected to a gear-train via an infinitely adjustable torque transfer assembly. The torque transfer assembly utilizes a belt and pulleys to transfer torque from the motor to the gear train via a foot pedal operated cantilever which forces an idler pulley against the belt to selectively couple and decouple the DC motor to and from the reel to modulate the pulling force and rotational speed of the hose reel. When the foot pedal is depressed the main power switch of the control assembly allows current from the battery to start the DC motor and forces the idler pulley to tension the belt to provide the desired speed and/or force required for hose retrieval. Release of the pedal stops the motor and allows hose to be freely pulled from the reel as desired.

Because motors often operate at relatively high RPM the DC motor may include a gear-train coupled between the DC motor and the infinitely adjustable torque transfer assembly. The gear-train is capable of reducing RPM output and increasing motor torque.

Power for the control assembly is provided by a removable, replaceable, and rechargeable battery assembly conveniently stored within its own closed compartment in the enclosure. Connection to the battery is made via a unique clip-on connector that also provides an integrated battery charging jack. The clip-on connector is constructed and arranged to prevent the clip from being incorrectly connected to the battery and the assembly requires directional installation into the enclosure for electrical connection to the control assembly. The integrated charging jack in the clip-on connector allows convenient battery recharging without disconnecting the clip from the battery. In this manner the battery can be safely and easily removed, recharged, and/or reinstalled into the enclosure without danger of incorrect connection.

Therefore, it is an objective of the present invention to provide a motorized hose reel apparatus wherein the speed and/or force of hose retrieval is modulated by virtue of an infinitely adjustable torque transfer assembly.

It is a further objective of the present invention to provide a motorized hose reel apparatus that is constructed to utilize a DC power source.

It is still a further objective of the present invention to provide a motorized hose reel apparatus having a removable and rechargeable power source.

Yet another objective of the present invention is to provide a battery operated rechargeable motorized hose reel apparatus capable of protecting the hose during storage from direct contact with the elements.

Still another objective of the present invention is to provide a motorized hose reel apparatus that is aesthetically appealing to consumers.

Still yet another objective of the present invention is to provide a motorized hose reel enclosure that includes safety interlocks to prevent motorized operation when the enclosure is opened.

Still yet another objective of the present invention is to provide a unique clip-on battery connector.

Still yet another objective of the present invention is to provide a hose winding guide assembly that includes automatic as well as manual disengagement features.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
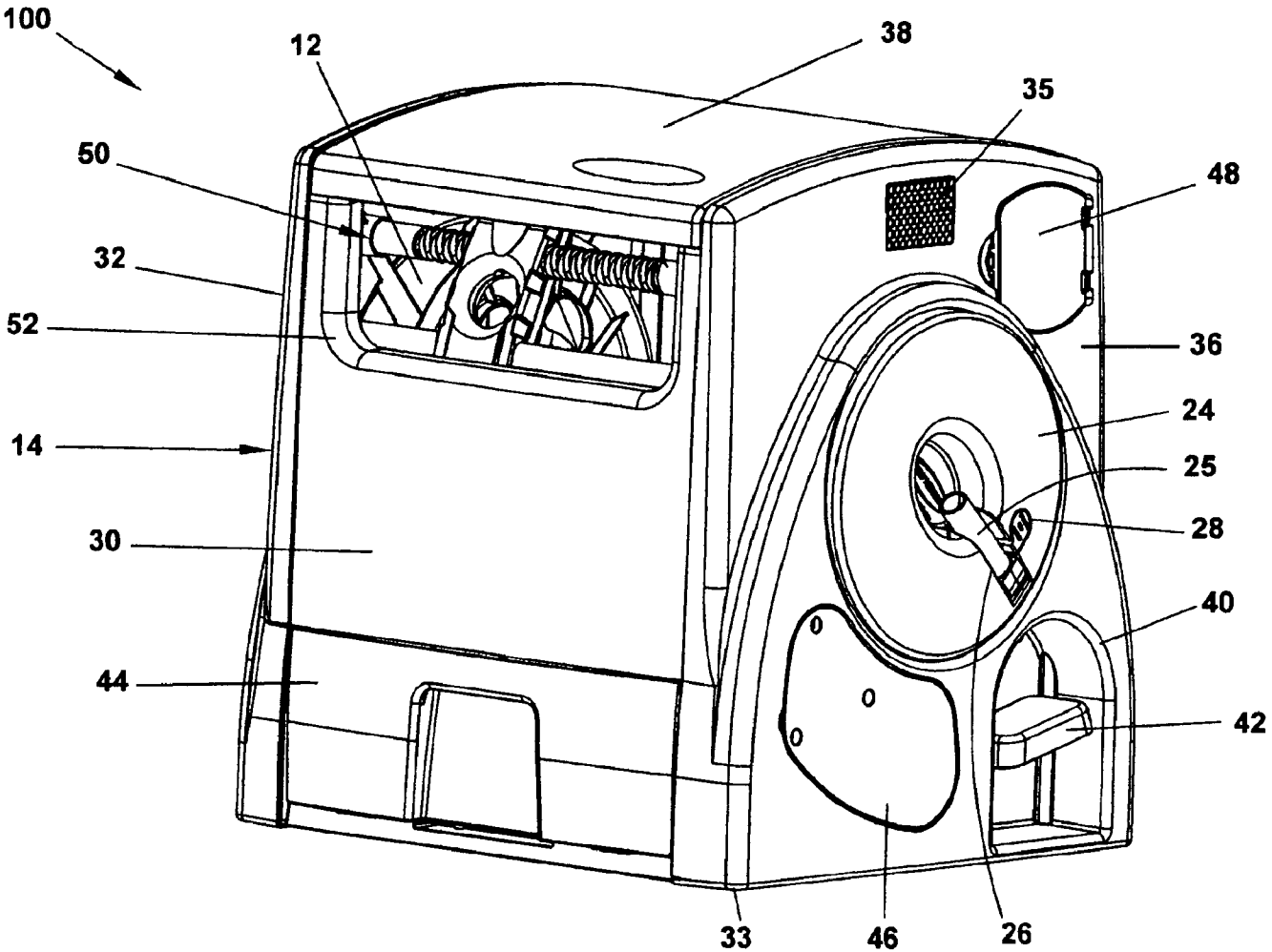
FIG. 1 is a perspective view of the motorized hose rewinding apparatus of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Referring now to FIG. 1, generally, there is shown a battery powered motor driven hose reel 100 in accordance with the principles of the present invention. The hose reel 100 includes a motor driven reel or spool 12 (FIG. 3) onto which the hose H is mechanically wound or taken up, and from which the hose H is manually fed out or paid out.

The enclosure 14 includes front wall panel 30 and rear wall panel 34, left side wall panel 32, right side wall panel 36, and a pivoting top or cover 38. Optionally, the enclosure 14 can include a bottom panel (not shown) for substantially fully enclosing the reel 12 and protecting the reel 12 and hose H from the elements. The optional bottom panel is preferably constructed as a reversible member with a enhanced friction engaging first surface and a relatively smooth second surface. In this manner the bottom panel could be inserted to prevent the apparatus from skidding on hard surfaces where staking is not practical. In addition, the bottom surfaces of the left side wall panel 32 and right side wall panel 36 may be constructed with optional rubber pads 33 to further engage hard surfaces. As will be apparent from the drawings, the front, rear and side panels 30–36, and the cover 38 enclose the reel 12 such that the reel is substantially not visible from outside of the enclosure 14 when the cover 38 is closed.

In a first embodiment the front panel 30 of enclosure 14 includes a cut-out portion 52 extending downwardly from the top lip thereof. The cut-out portion 52 can be elongated and is suitably sized to accommodate a standard size garden hose H so that the hose can be paid-out from or taken-up onto the spool 12 without lifting the cover 38. That is, the hose H can freely move through the cut-out opening 52 without opening the cover 38.

In a most preferred embodiment the front panel 30 of enclosure 14 includes an elongated cut-out portion 52 extending downwardly from a top lip thereof. The cut-out portion 52 is sized to accommodate a reciprocating hose guide assembly 50 so that the hose can be uniformly and smoothly wrapped on the reel 12 to provide a compact storage configuration or easily paid-out from the spool 12 without lifting the cover 38.

The enclosure 14 includes a drawer 44 that extends between the right and left side panels 36, 32, parallel to the front panel 30. The drawer 44 is illustrated as opening in a pivotal fashion but may also be configured to slide open for accommodating storage of hose attachments and the like.

The enclosure 14 includes a foot pedal housing 40 extending inwardly into the right side panel 36 for housing the foot pedal 42. The foot pedal housing 40 is used to protect the foot pedal from inadvertently being operated. The foot pedal housing 40 can be provided in a variety of configurations suitable for protecting the pedal 42 from inadvertent operation, which configurations will be recognized by those skilled in the art. A manual override winding crank 24 is external of the enclosure 14 and extends through a side wall for connection to the spool 12, preferably on an end opposite to that of the in-tube 20 (FIG. 3), to facilitate manual take-up of the hose H. The crank 24 includes a folding handle 25 capable of folding into a recess 26 formed in the crank 24. The handle releasable lock 28 in the crank 24 cooperates with detents in the handle 25 to permit the handle 25 to be locked into either a position parallel to the crank or a position perpendicular to the crank. Locking the handle 25 in the perpendicular position permits the hose reel to rotate without the danger of the rotating handle hitting or snagging objects or persons within its path and also permits a compact enclosure.

Figure 2:
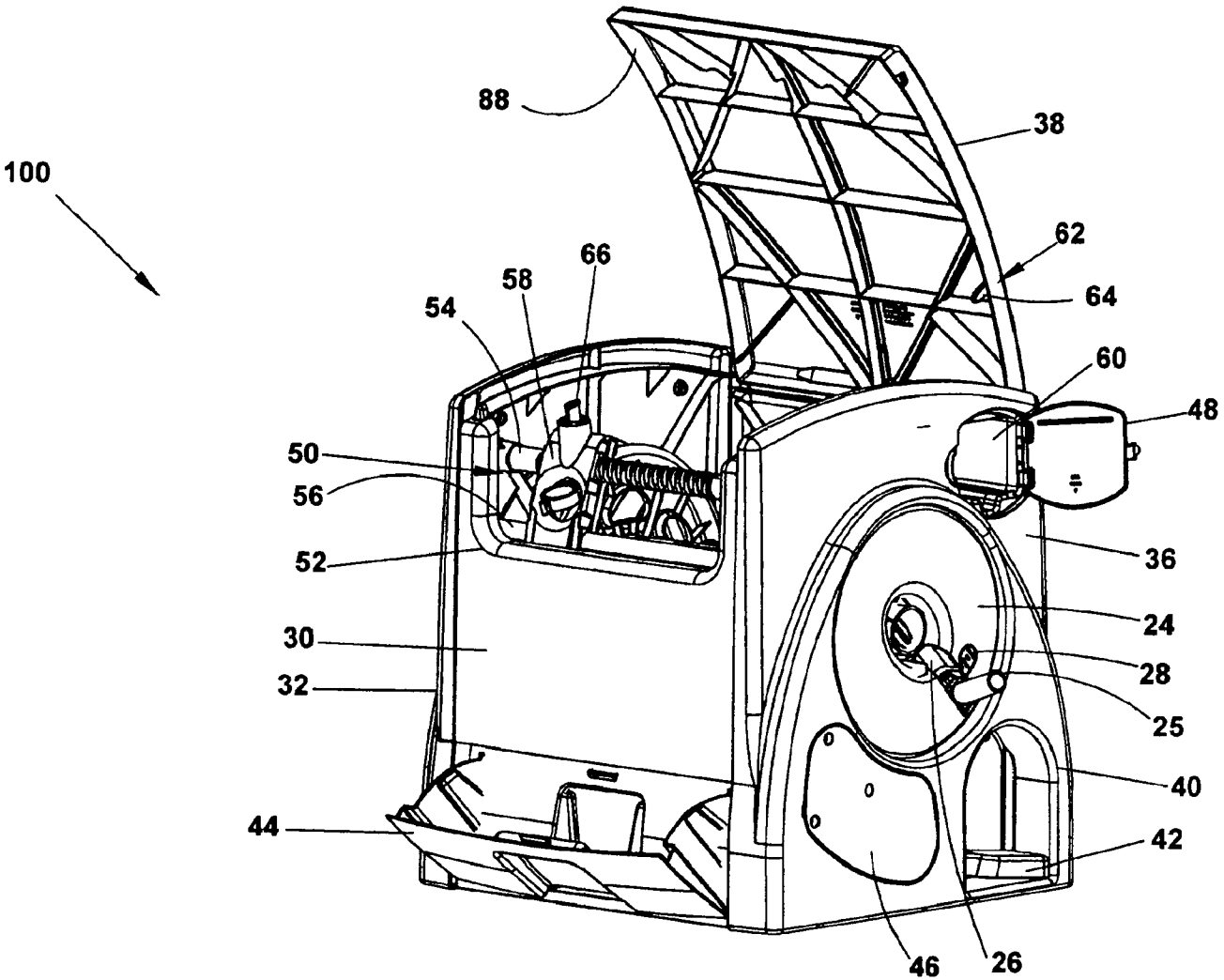
FIG. 2 is a perspective view with the cover open and hand crank extended.
Figure 3:
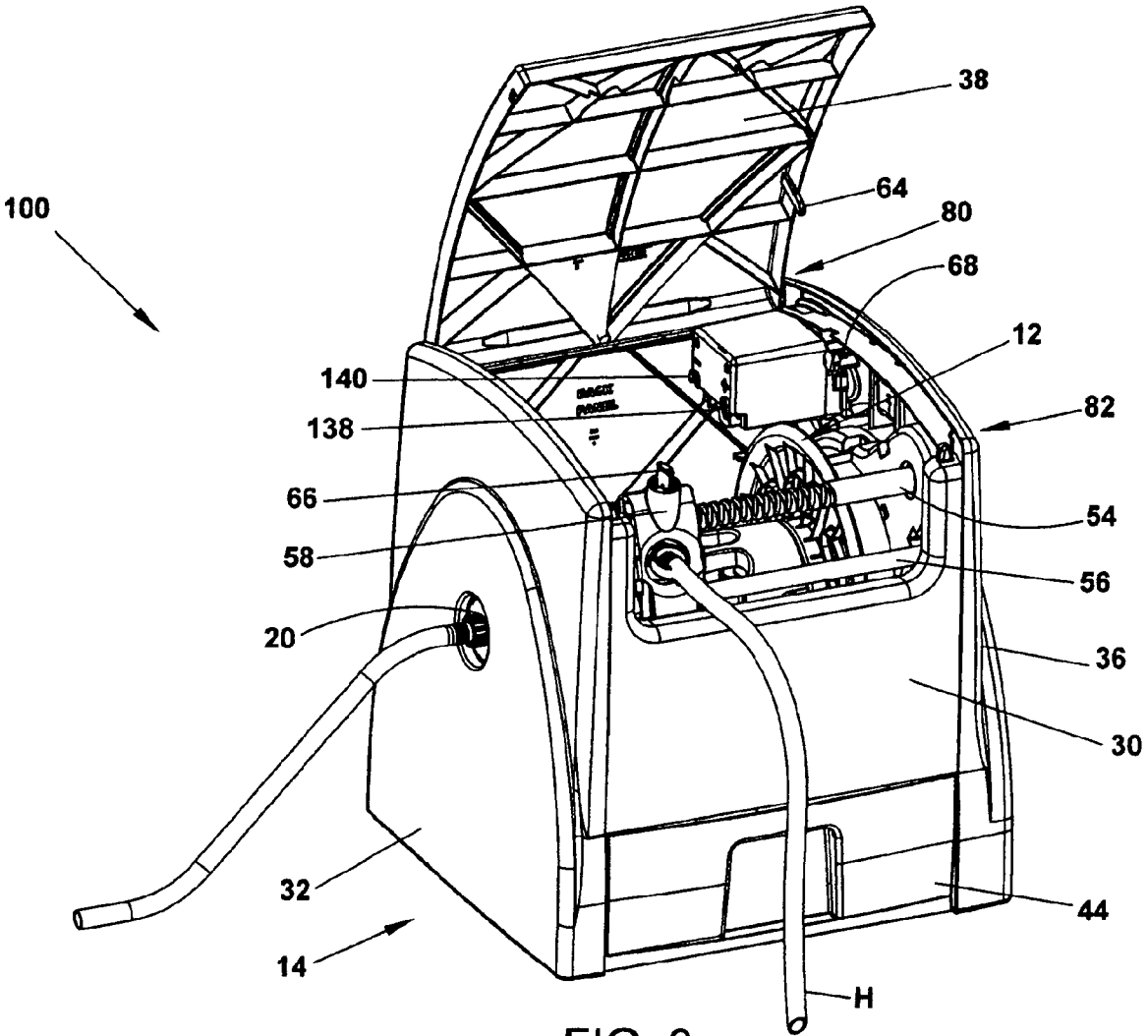
FIG. 3 is a perspective view illustrating hose line connections.

Now referring to FIG. 2, the motorized hose rewinding apparatus 100 is illustrated with the cover 38, drawer 44, battery cover 48, and handle 25 all in their respective open positions. Incorporated into the enclosure cover 38 is a lockout assembly 62 that prevents the direct current motor 98 (FIG. 8) from operating when the cover 38 is in the open position. The lockout assembly 62 is illustrated as but not limited to an engagement pin 64 cooperating with a normally open micro-switch 68 (FIG. 3). Other devices well known in the art suitable for sensing an open cover and locking out electrical devices when the cover is open may be substituted for the pin and switch assembly illustrated herein. Such devices may include but should not be limited to micro-switches, proximity switches, mercury switches, mechanical switches, optical switches and the like.

Also visible is the reciprocating hose guide assembly 50. The reciprocating hose guide assembly contains a double helix lead-screw 54, guide rod 56, and carriage 58. The reciprocating hose guide assembly 50 is linked via gear-train 96 (FIG. 8) to the hose reel 12 so that when the hose reel 12 is rotated, the double helix lead-screw 54 rotates at a desired ratio with respect to the hose reel 12. The lead-screw is journaled for rotation between side members 32 and 36 and is substantially parallel to the central hub portion of spool 12. The lead-screw 54 engages the carriage 58 via follower 66, allowing the carriage 58 to move back and forth across the lead-screw 54 and the guide rod 56 when engaged during both manual and motorized operation. The follower 66 can be manually disengaged from the lead-screw 54 to permit easy pay-out of hose H or repositioning of the carriage 58. Operation of the hose guide assembly 50 permits hose H to be uniformly and smoothly wrapped on the reel 12 to provide a compact storage configuration. Optionally the follower 66 may include a disengagement feature that permits the carriage 58 to release from the lead-screw 54 in the event that the carriage 58 is obstructed during motorized or manual hose H rewinding.

Figure 4:
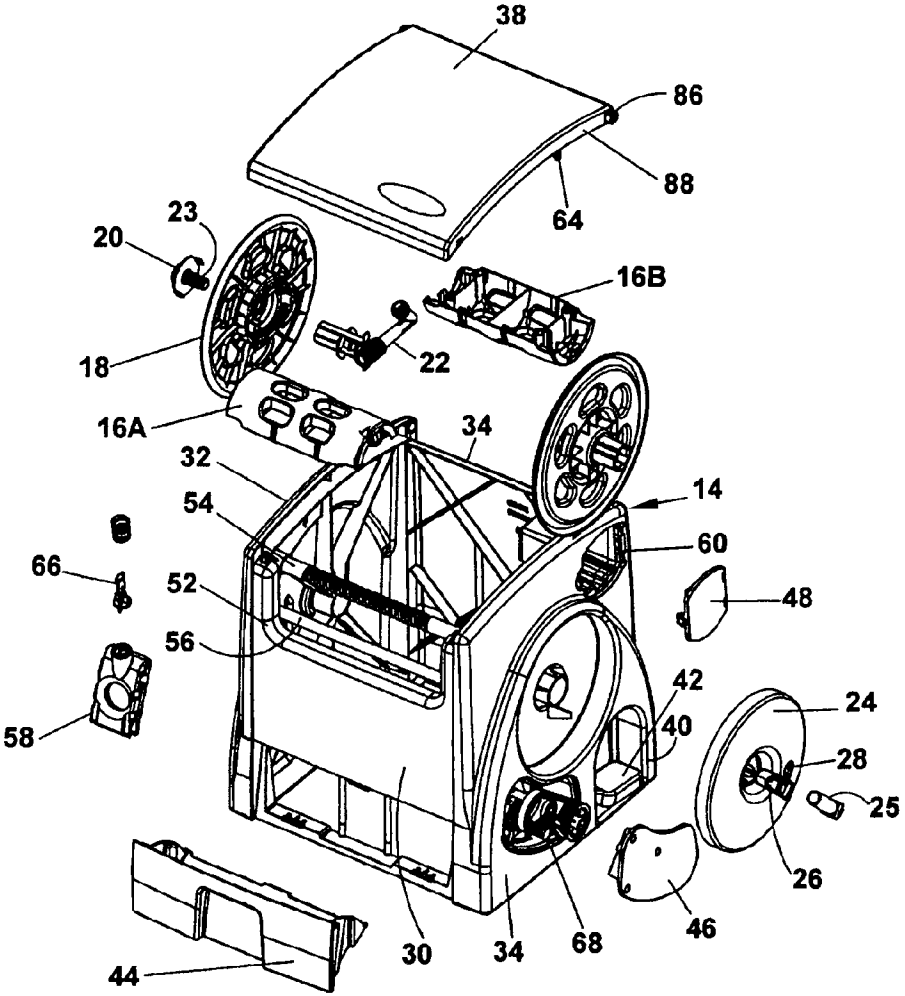
FIG. 4 is an partially exploded view.

Referring to FIG. 4, the reel 12 is supported by and rotatably mounted within the enclosure 14. The reel 12 includes a central hub 16 constructed of two mating halves 16A and 16B and a pair of radially extending flanges 18 that are configured to accommodate a length of the flexible hose H wrapped around the hub 16 between the flanges 18. In a typical arrangement, the hose reel 12 can store upward of 300 ft. of ⅝ inch garden hose H.

Those skilled in the art will recognize that the hose reel 12 includes a water inlet port or in-tube 20 and an outlet port or out-tube 22. The in-tube 20 is mounted to the enclosure 14 at about the axis of rotation of the reel 12. The in-tube 20 is connected to the out-tube 22 by a sliding seal arrangement 23 which will be recognized by those skilled in the art. This arrangement permits the in-tube 20 to remain fixed to the enclosure 14, while the out-tube 22 rotates with the reel 12. In this configuration, the in-tube 20 and out-tube 22 remain in fluid communication with one another. This arrangement permits rotating the reel 12 without twisting or torquing internal components, while maintaining sealed fluid communication between the water supply and the hose H.

The adjustable torque transfer assembly 68 is visible with the structural transfer cover 46 removed. The transfer cover 46 cooperates with the right side panel 36 to provide support to the adjustable torque transfer assembly.

Figure 5:
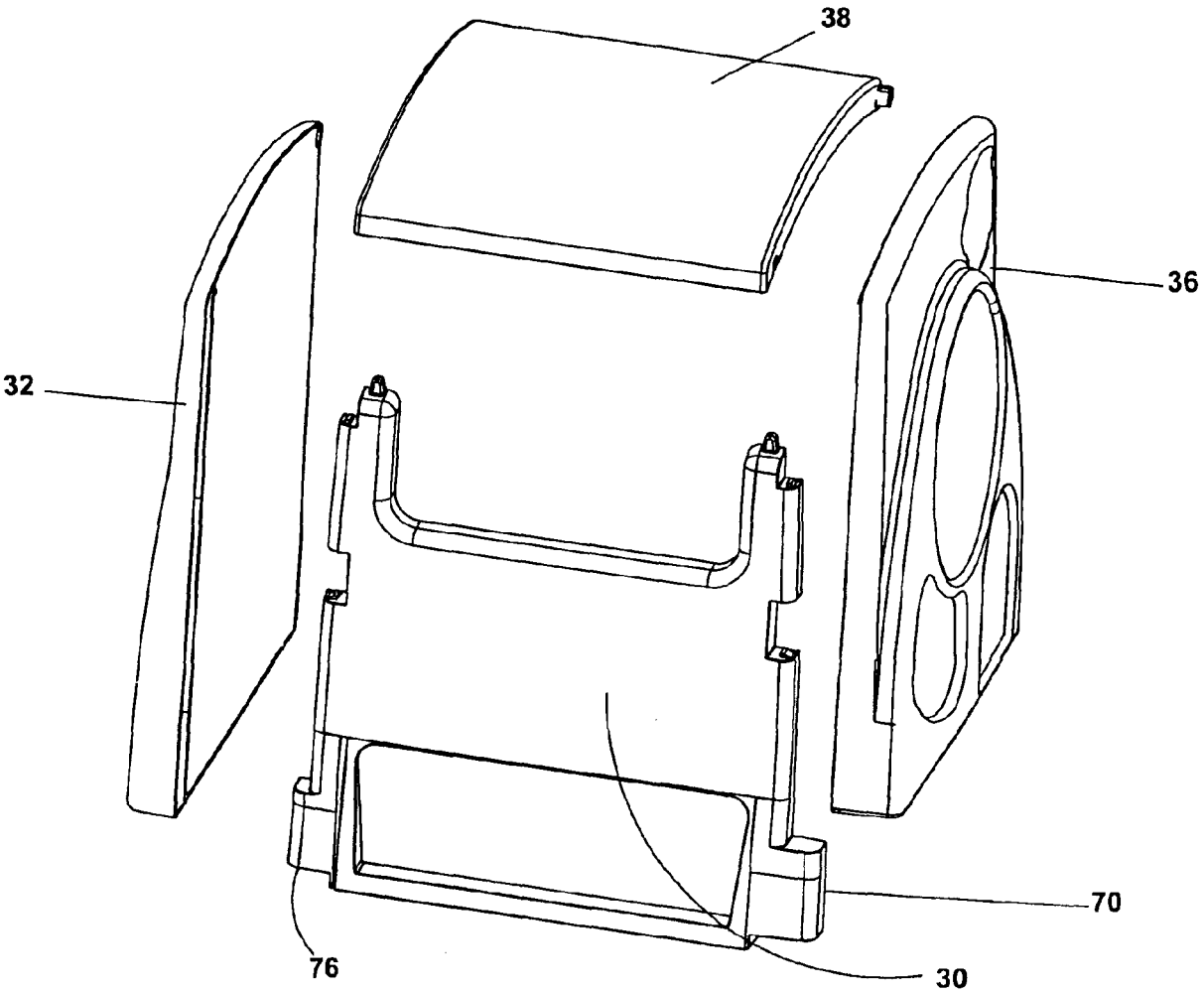
FIG. 5 is an exploded perspective view of the cabinet enclosure.

Referring to FIG. 5, an exploded view of the enclosure is shown. The panels 30–38 are preferably molded components formed from high strength polymeric (plastic) material, such as polystyrene and the like. The panels 30–38 are most preferably configured such that the front and rear panels 30, 34 have contoured projections 70 that insert into recesses or channels 72 formed in support posts 74 that extend vertically along each side of the side wall panels 32, 36. The contoured projections 70 include ramped surfaces or snap-type elements 76 that engage openings 78 in the channels 72 to lock the panels to one another.

Advantageously, this configuration permits ready assembly of the enclosure 14 with a minimum number of tools, and involves a minimum number of parts.

The cover or top panel 38 is fitted to the panels 30–36 using a hinge arrangement indicated generally at 80 (FIG. 3) and latch arrangement generally at 82, best seen in FIGS. 2 through 7. The hinge arrangement 80 permits pivoting or rotating the cover 38 between the closed position shown in FIG. 1 and the open position shown in FIG. 2. The cover 38 is configured so that when opened and maintained in the open position use of the motorized reel is locked out via lockout assembly 62 (FIG. 2).

Figure 6:
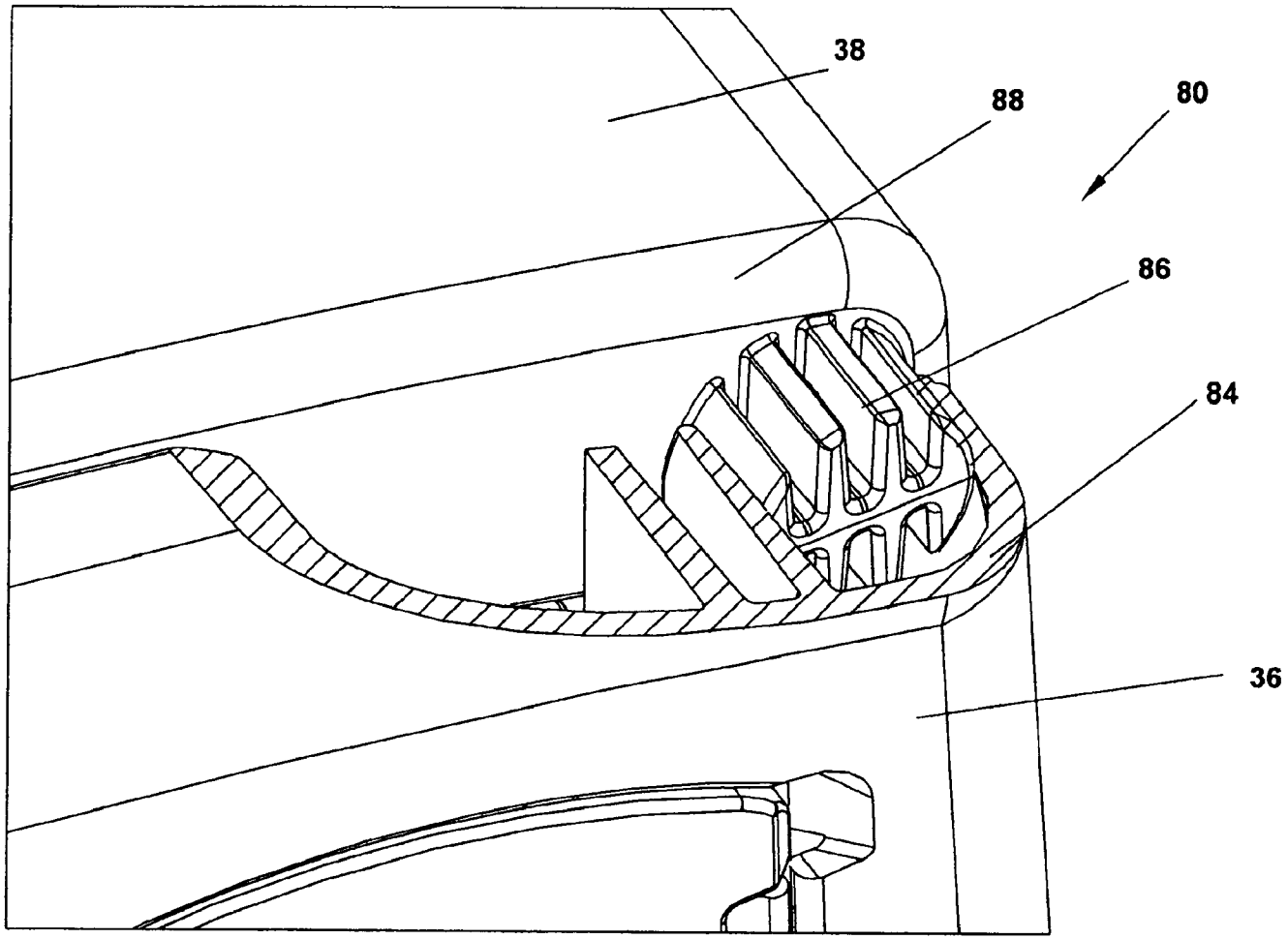
FIG. 6 is a partial section view with a portion thereof being broken away, illustrating the top cover hinge arrangement.

Referring to FIG. 6, a partial view having a portion thereof broken away illustrating the hinge arrangement. The hinge arrangement 80 includes a pocket 84 formed in each of the side panels 32, 36 at about the upper rear corners as indicated at (FIG. 4). A pair of outwardly extending pivot pins 86, extend from each side of the rear corners of the cover 38. In a present embodiment, the cover 38 has a depending lip 88, from which the pivot pins 86 extend. Each of the pivot pins 86 is configured to engage a respective pocket 84. The pins 86 are configured to cooperate with their respective pocket 84 to permit pivoting or rotating the cover 38.

Figure 7:
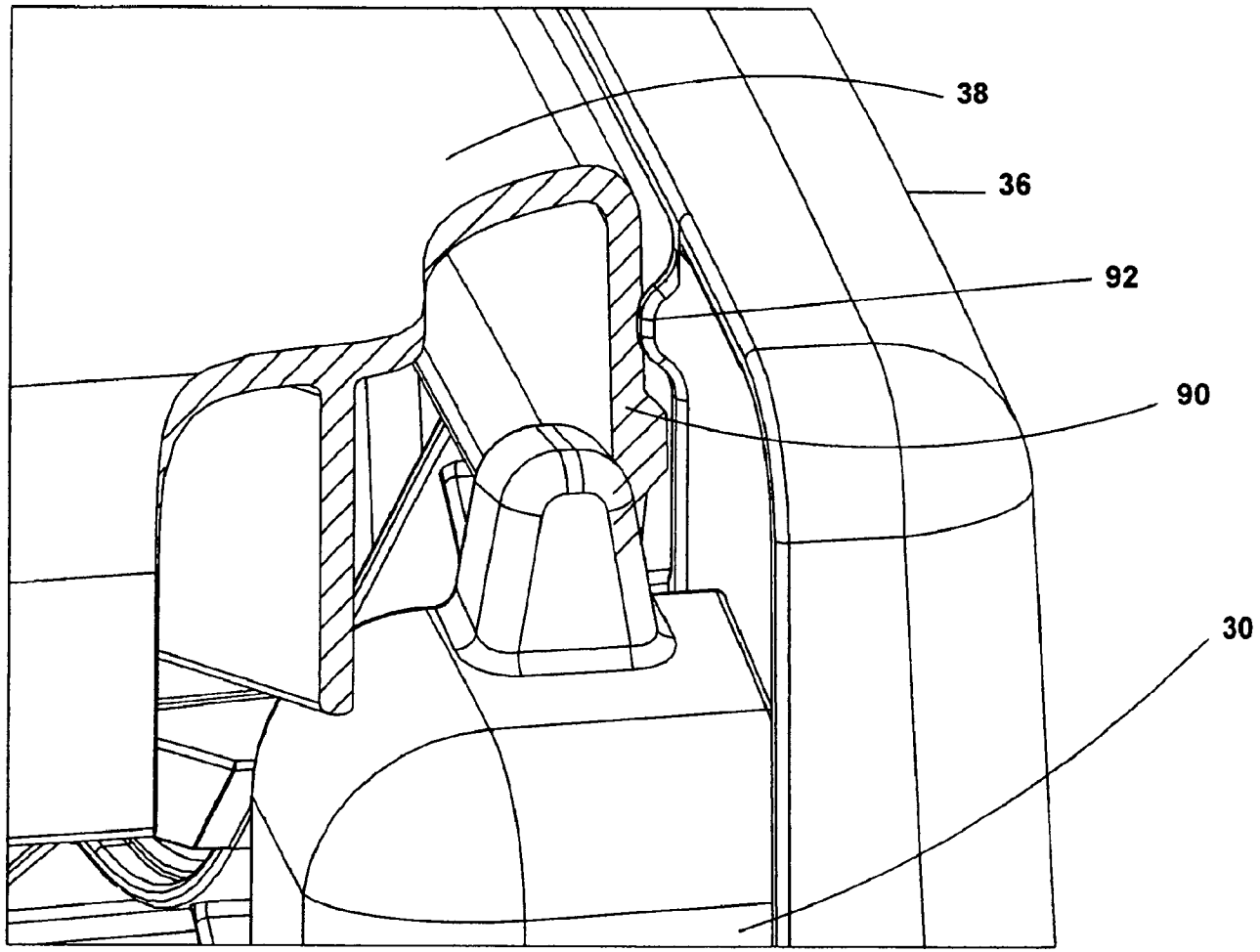
FIG. 7 is a partial section view, illustrating the cover latch arrangement.

As illustrated in FIG. 7, the releasable latch arrangement 82 is engagingly oriented when the cover 38 is in the closed position. The latch arrangement prevents pets and wild animals from hiding within the enclosure. The releasable latching means is illustrated by but should not be limited to, a catch and detent arrangement, other latching devices well known in the art, capable of releaseably holding the cover of the enclosure in a closed position, may be utilized. In the closed position, the catches 90 extending from the depending lip 88 are engaged with the respective side panels 32 and 36. To open the cover 38, it is necessary only to pivot the cover 38 upward which releaseably urges the catches 90 upward past the detents 92.

Figure 8:
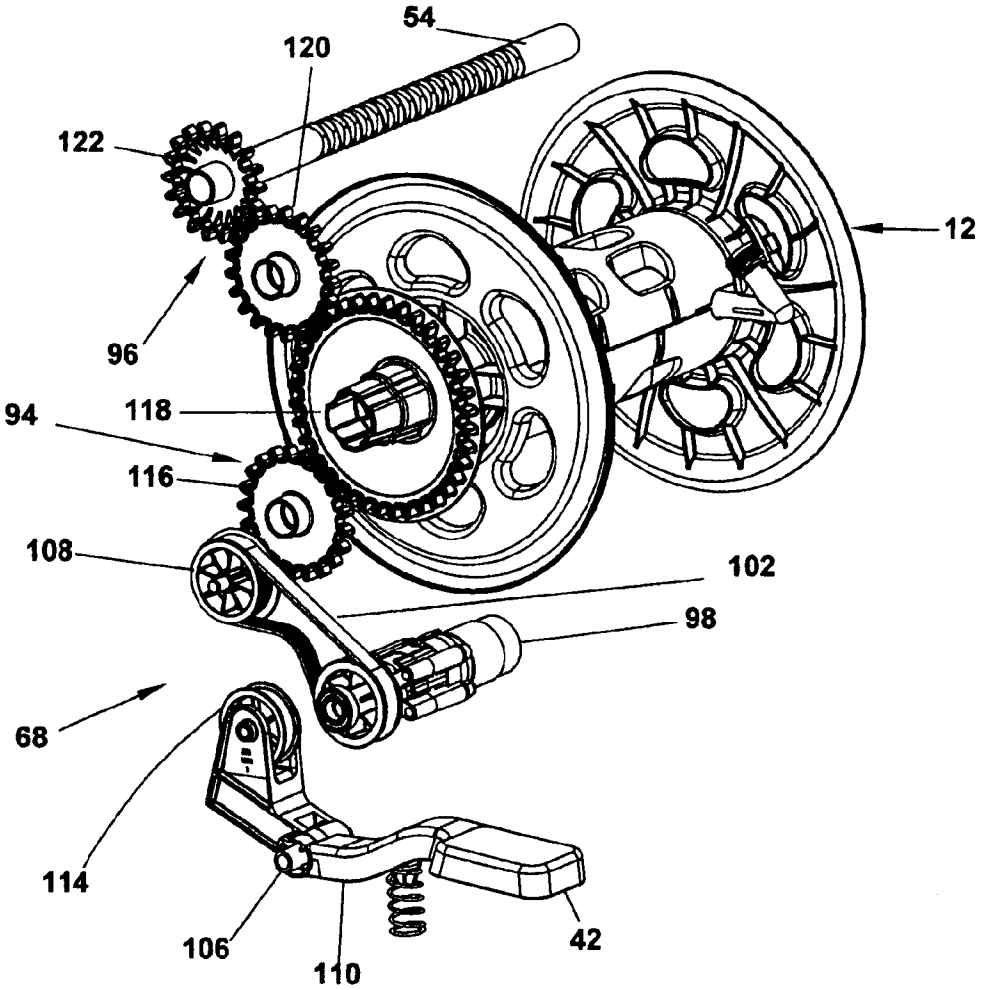
FIG. 8 is a perspective view of the gear-train assembly.
Figure 9:
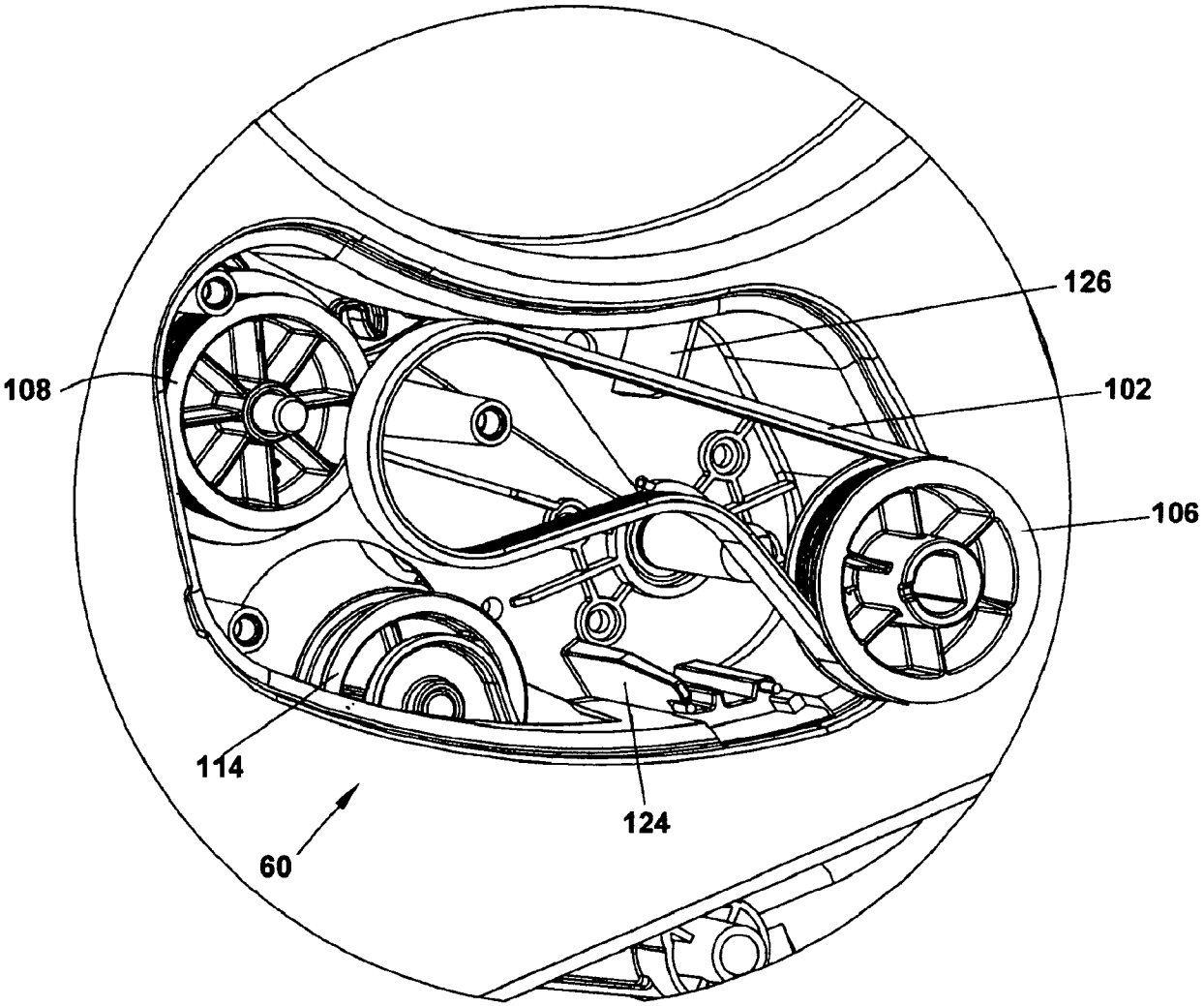
FIG. 9 is a partial view of the adjustable torque transfer assembly.

Referring to FIG. 8, the infinitely adjustable torque transfer assembly 68, reel gear-train 94, and hose guide gear-train 96 are shown. For motorized operation, the motorized hose rewinding apparatus 100 is provided with a DC powered motor 98 connected to the reel gear-train 94 via an infinitely adjustable torque transfer assembly 68 which is illustrated, by but not limited to a belt and pulley configuration. A torque transfer belt 102 passes around the drive pulley 106 and the driven pulley 108 coupled to a reel gear-train 94 to provide controlled rotational movement of the reel 12. A second assembly rotatably mounted within the enclosure is illustrated as a cantilever 110 having a foot pedal 42 on a first end and a idler pulley 114 on the second end to allow the operator to modulate the pulling force and rotational speed of the motorized hose reel 12. When the foot pedal 42 is depressed the current from the battery 132 (FIG. 11) flows through a fuse and is allowed to start the DC motor 98 and force the idler pulley 114 to tension the belt 102 to provide the desired speed and/or force of hose H retrieval. Release of the pedal 42 stops the motor 98 and releases pressure from the idler pulley 114, and allows the belt to ride freely over the pulleys. Optional belt positioner tabs 124 and 126 (FIG. 9) retain the torque transfer belt in position around pulley 106 while causing the belt to billow around pulley 108, thereby allowing hose H to be freely pulled from the reel 12 without causing the motor 98 to rotate in reverse. In this manner, the operator of the present invention can easily regulate the rewinding of hose H around the reel 12 as well as allow hose H to be manually paid out. It is understood and anticipated that other torque transfer arrangements well known in the art could be substituted for the belt and pulley arrangement disclosed herein. Other torque transfer mechanisms may include but should not be limited to plate type clutches and couplings, cone type clutches and couplings, slip type clutches and couplings, spring applied clutches and couplings, centrifugal clutches and couplings, pneumatic clutches and couplings, hydraulic type clutches and couplings, Sprag type clutches and couplings and electromagnetic type clutches and couplings.

When the pedal is depressed the motor rotates the reel through the action of the torque transfer assembly 68 and the reel gear-train. That is, the motor 98 rotates the first pulley 106, the torque assembly operatively engages and rotates driven pulley 108 through the belt 102, the driven pulley 108 is coupled or formed integral with the drive gear, the drive gear rotates the idler gear 116, that rotates the hose reel gear 118 to complete the reel gear-train. The hose winding guide lead-screw 54 is caused to rotate through the action of gears 118, 120, and 122. That is, when reel 12 is rotated by motor 98 or by handle 25, the reel 12 and reel gear 118 rotates, which causes the idler gear 120 to rotate, which causes lead screw 54 to also rotate.

Figure 10:
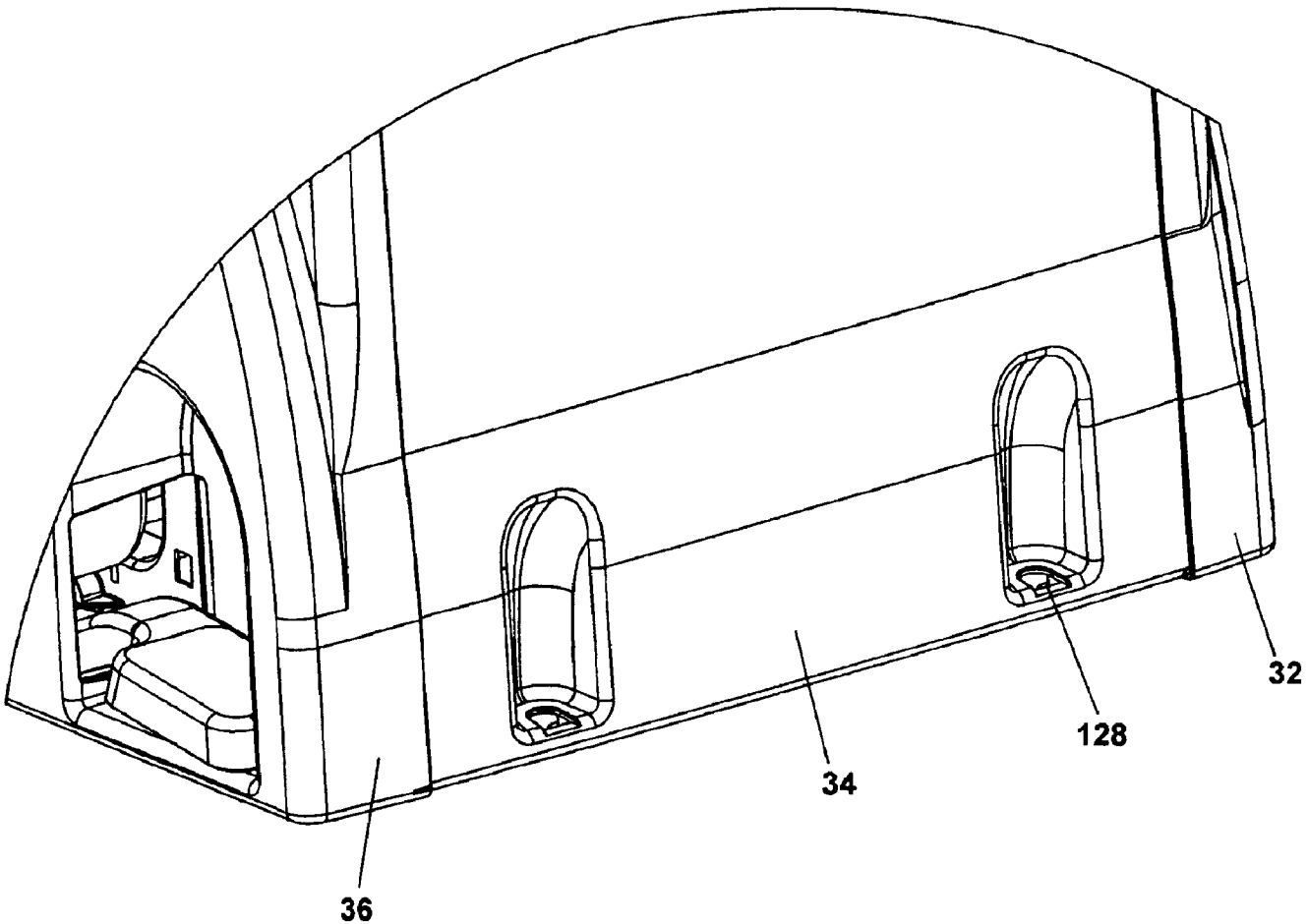
FIG. 10 is a partial rear view illustrating the recessed anchoring apertures.

Referring to FIG. 10, the lower portion of rear panel 34 of enclosure 14 is shown. The rear panel contains at least one and preferably two recessed anchoring apertures 128. The recessed apertures allow the enclosure to be securely attached to a desired surface with an attachment means such as lag bolts, spikes or metal stakes, to prevent unwanted movement of the apparatus during motorized/manual rewinding or manual pay-out of hose. It should be appreciated that recessing the anchoring apertures increases safety by eliminating objects extending outwardly from the enclosure.

Figure 11:
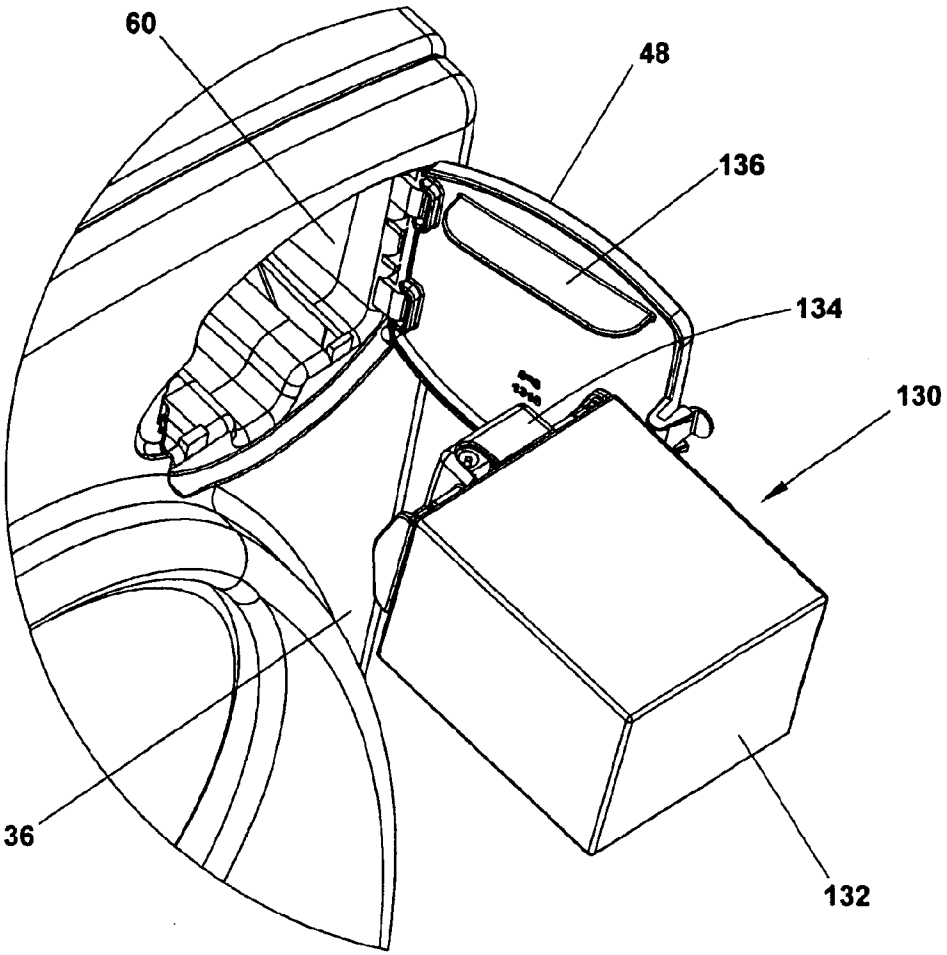
FIG. 11 is a partial exploded view illustrating the battery assembly.

Referring to FIG. 11, the battery compartment and the DC power supply are shown. The battery compartment 60 is generally located in the upper rear corner of the right panel 36. The battery compartment is constructed and arranged in a manner that allows the battery assembly to be directionally slid into the compartment for electrical cooperation. That is, there is no need to connect wires to the battery assembly to operate the device. The battery compartment contains a pair of electrical contacts 138, 140 (FIG. 3), positioned in a manner so that electrical contact is made only if the battery assembly is correctly installed.

The battery compartment 60 is provided with a hinged door 48 having a latch arrangement for releasably engaging side panel 36. Formed integrally to the inside of the battery cover door is a vertical battery hold down 136. When the door 48 is latched in the closed position the battery compartment electrical contacts 138, 140 and the battery assembly electrical contacts 144, 146 (FIG. 13) are maintained in a cooperating relationship. In this manner, the battery assembly is removable and replaceable without the need to attach wiring.

Figure 12:
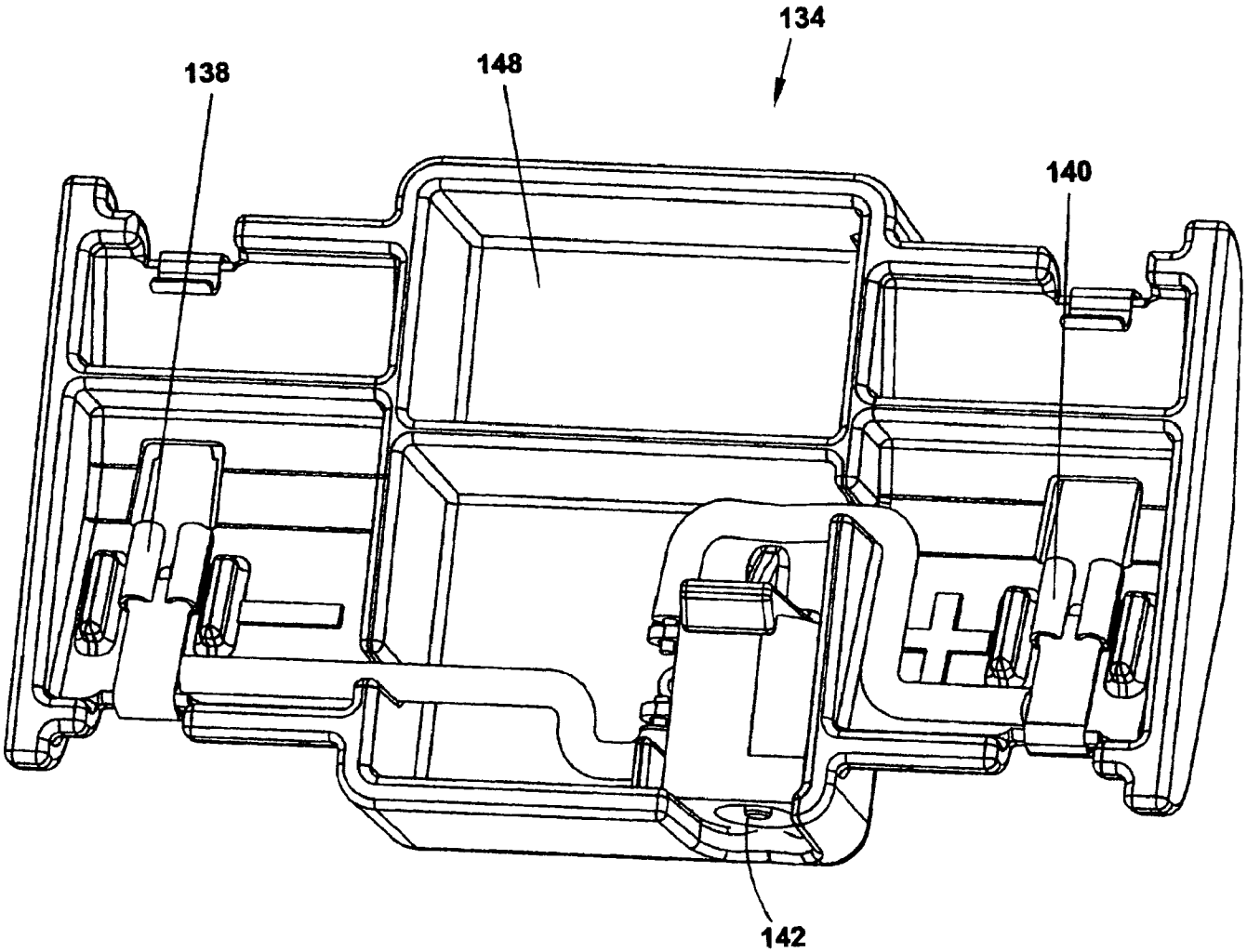
FIG. 12 is a perspective view of the underside of the clip assembly utilized in the present invention.
Figure 13:
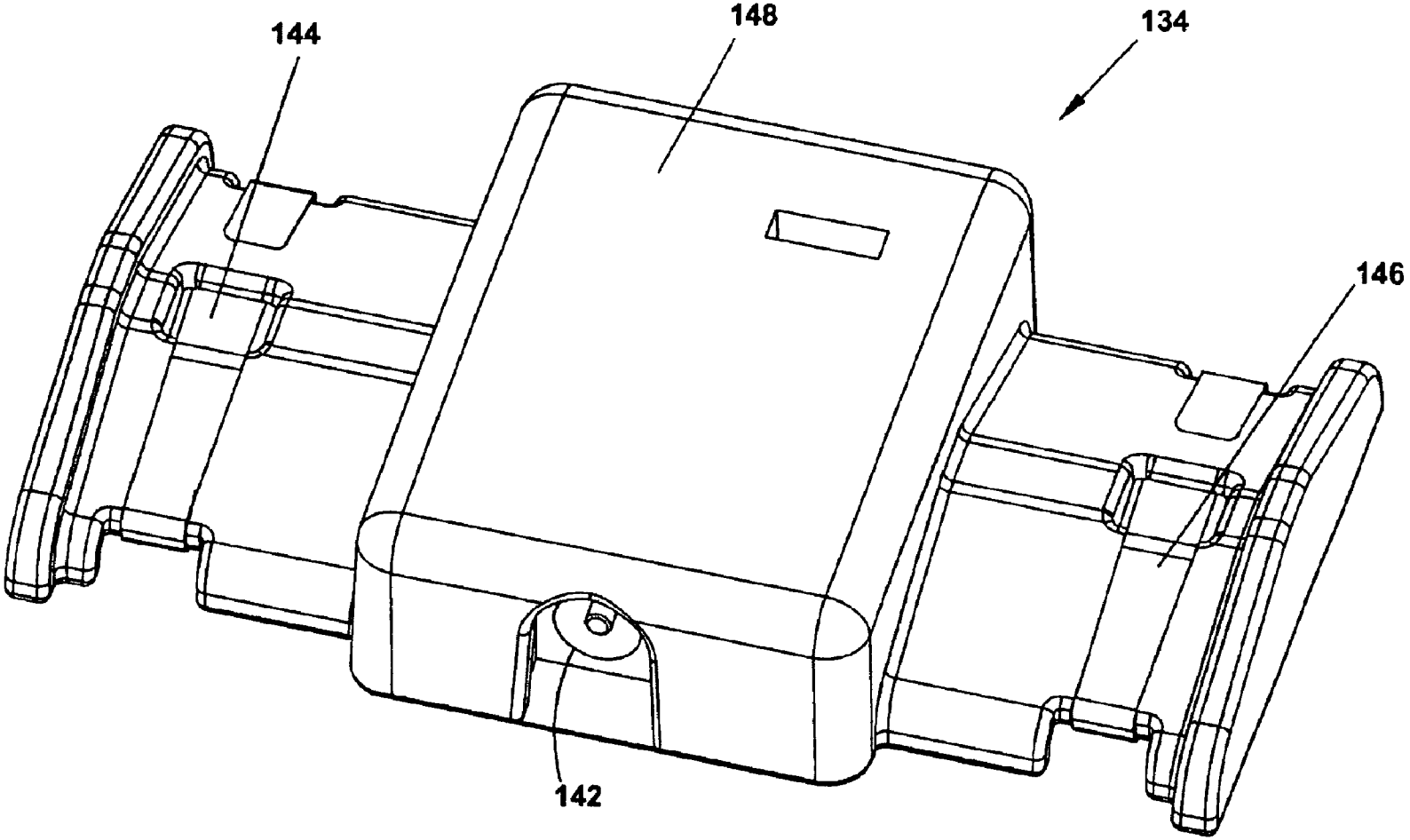
FIG. 13 is a perspective view of the battery clip assembly.

Referring to FIGS. 12 and 13, a perspective view of the underside (FIG. 12) and the topside (FIG. 13) of the battery clip 134 is shown. The battery clip 134 contains two conductive battery quick connectors 138, 140 and a recharging jack 142 removably attached to a non-conductive cap 148. The conductive quick connectors 138, 140 are constructed and arranged to slidably connect to battery terminals (not shown) and conduct current from the battery 132 to contacts 144 and 146 (FIG. 13) located in a juxtaposed position to the upper surface of the non-conductive cap 148. The contacts 144, 146 are positioned on the non-conductive cap 148 to allow operation of the motorized hose reel 100 only if the battery assembly 130 is inserted into the battery compartment 60 in the correct directional manner. The recharging jack 142 allows the battery to be recharged without disconnecting the clip 134 from the battery 132. In this manner the battery clip can be easily attached and removed to the battery allowing the assembly to be removable, replaceable, and rechargeable.

Figure 14:
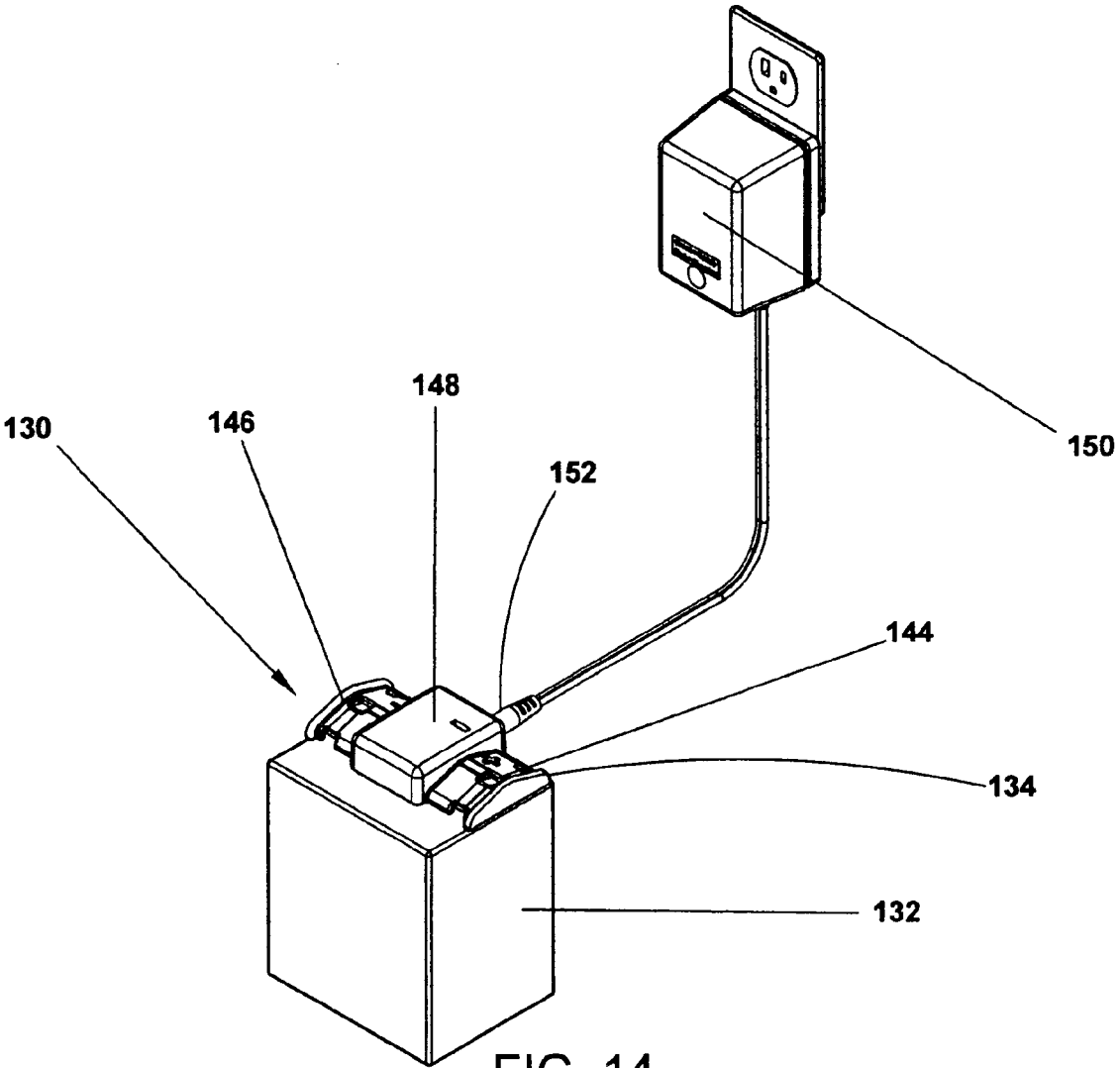
FIG. 14 is a pictorial view of the battery and charger assembly.

Referring to FIG. 14, a perspective view of the battery assembly 130 cooperating with the battery charging means illustrated herein as battery charger 150. The battery charger 150 is constructed and arranged to utilize a plug 152 that mates with charging jack 142 for charging the battery 132. Battery chargers that utilize household to recharge low voltage DC batteries are well known in the art and a detailed description will therefore be omitted. In a preferred but non-limiting embodiment the instant invention may utilize solar cells 35 (FIG. 1) as a means to recharge the battery 132. The solar cells 35 are incorporated into one or more of the various panels of the enclosure and are in electrical communication, e.g. wired, to transfer the energy generated to the battery for storage. Solar cells that utilize bright sunlight to recharge low voltage DC batteries are well known in the art and a detailed description will therefore be omitted.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A direct current powered hose winding apparatus for use with an associated flexible hose comprising:

a reel having a hub defining an axis of rotation and a pair of flanges at opposing ends of said hub and perpendicular to said axis of rotation;

an enclosure having side wall panels, front and rear wall panels extending between said side wall panels, and a cover, said enclosure being constructed and arranged to receive said reel, said reel being rotatably mounted within said enclosure;

a winding means constructed and arranged to provide infinite rotational movement of said reel in relation to said enclosure; and a direct current energized power assist means including;

a direct current motor;

an infinitely adjustable torque transfer assembly, said torque transfer assembly including;

a drive pulley coupled to said direct current motor;

a driven pulley coupled to said reel;

a torque transfer belt extending loosely between and around said drive pulley and said driven pulley;

an idler pulley for selectively engaging said torque transfer belt for selectively tensioning said torque transfer belt thereby enabling said direct current motor to rotate said reel; and a control assembly, said control assembly constructed and arranged to control power supplied to said direct current motor;

wherein said infinitely adjustable torque transfer assembly is configured to selectively and variably engage said direct current motor to said reel;

whereby variable torque and rotational speed or free rotation of said reel is provided.

2. The hose winding apparatus in accordance with claim 1 wherein said control assembly further includes a direct current power source.

3. The hose winding apparatus of claim 2 wherein said direct current power source is a battery assembly, constructed and arranged for electrically polarized and mechanical engagement with said control assembly.

4. The hose winding apparatus in accordance with claim 3, wherein said battery assembly includes:

a battery for supplying direct current to said control assembly and said direct current motor; and a battery clip constructed and arranged for removable attachment to said battery;

whereby said battery clip conducts power from said battery to said control assembly and said direct current motor.

5. The hose winding apparatus in accordance with claim 4 wherein said battery clip includes a recharging jack;

whereby said battery is rechargeable via electrical communication with recharging means and said battery assembly is removable from said enclosure and replaceable within said enclosure.

6. The hose winding apparatus in accordance with claim 5 wherein said recharging means utilizes solar energy.

7. The hose winding apparatus in accordance with claim 5 wherein said recharging means utilizes household current.

8. The hose winding apparatus in accordance with claim 1 wherein said direct current motor further includes a gear-train, said direct current motor gear-train increasing rotational torque of said direct current motor and reducing rotational output speed of said direct current motor;

wherein said motor gear-train is coupled between said direct current motor and said infinitely adjustable torque transfer assembly.

9. The hose winding apparatus in accordance with claim 2, wherein said control assembly further comprises a main power switch for electrically connecting and disconnecting said direct current motor to and from said power source.

10. The hose winding apparatus in accordance with claim 9, wherein said control assembly further comprises at least one safety interlock for disabling said main power switch and preventing electrical connection between said direct current motor and said power source.

11. The hose winding apparatus in accordance with claim 1, wherein said infinitely adjustable torque transfer assembly includes a second assembly coupled to said enclosure for rotatably supporting said idler pulley between a first position spaced apart from said torque transfer belt to allow said torque transfer belt to ride freely over said drive pulley and said driven pulley to allow said hose to be freely pulled from said reel, and a second position in engagement with said torque transfer belt to put variable tension on said torque transfer belt;

wherein said direct current motor rotates said reel to rewind said hose.

12. The hose winding apparatus in accordance with claim 11, wherein the second assembly includes a cantilever, said cantilever being rotatably mounted to said enclosure, said cantilever having a first end and a second end, said first end of said cantilever constructed and arranged to rotatably support said idler pulley, said second end of said cantilever constructed and arranged to provide a foot pedal for foot operation, wherein said foot operation selectively forces said idler pulley between said first and said second positions.

13. The hose winding apparatus in accordance with claim 12, wherein operation of said cantilever further operates said main power switch, wherein electrical connection is made between said direct current motor and said power source during operation of said foot pedal and power is disconnected between said direct current motor and said power source when said foot pedal is not operated.

14. The hose winding apparatus in accordance with claim 1, wherein said infinitely adjustable torque transfer assembly further includes at least one belt positioner tab, said at least one positioner tab retaining said torque transfer belt in a juxtaposed position in relation to said drive pulley and causing said torque transfer belt to billow around said driven pulley;

wherein said hose may be freely pulled from said reel while said idler pulley is in a first position.

15. The hose winding apparatus in accordance with claim 1, wherein said infinitely adjustable torque transfer assembly further comprises a gear-train, said gear-train coupled between said driven pulley and said reel.

16. The hose rewinding apparatus in accordance with claim 15, wherein said gear-train comprises:

a reel gear secured to said hub of said reel, said reel suitably journaled in said enclosure to allow rotational movement of said reel;

a drive gear suitably attached to said driven pulley of said infinitely adjustable torque transfer assembly; and at least one idler gear rotationally secured within said enclosure and intermeshing with said drive gear and said reel gear;

wherein said drive gear provides rotation of said at least one idler gear and said at least one idler gear provides rotation to said reel gear and said reel secured thereto.

17. The hose winding apparatus in accordance with claim 1 wherein said torque transfer assembly includes:

an idler pulley assembly, said idler pulley assembly constructed and arranged to allow operator controlled tensioning of said torque transfer belt; and at least one positioner tab for holding said torque transfer belt in juxtaposed relationship to said drive pulley;

wherein when said hose winding device is in a pay-out mode, said at least one belt positioner tab retains said torque transfer belt in juxtaposed relationship to said drive pulley while causing said torque transfer belt to billow around said driven pulley, thereby allowing said hose to be manually pulled from said reel without causing said direct current motor to rotate in reverse.

18. The hose winding apparatus in accordance with claim 17 wherein said idler pulley assembly includes a foot operated cantilever, said cantilever having a first end and a second end, said idler pulley rotatably mounted to said first end of said cantilever, said second end of said cantilever including a foot pedal;

wherein operator controlled tensioning of said torque transfer belt is accomplished and torque from said drive pulley is controllably transferred to said driven pulley thereby providing rotational motion to said reel.

19. The hose winding apparatus in accordance with claim 1, wherein said enclosure comprises:

an enclosure having left and right side wall panels, front and rear wall panels, extending between the left and right side wall panels, and a cover, the enclosure being configured for receiving said reel so as to rotate within said enclosure and for storing a length of flexible hose on said reel within said enclosure;

a pair of hinges for mounting said cover to said enclosure for movement between a closed position and an open position, each hinge including a pocket formed in a respective side wall panel and a pin associated and cooperative with each said pocket, each said pocket configured to permit rotational movement of said pins for upward rotational movement of said cover.

20. The hose winding apparatus in accordance with claim 19 wherein said enclosure includes an opening therein configured for take-up and pay-out of said flexible hose when said cover is in the closed position.

21. The hose winding apparatus in accordance with claim 19 wherein said front wall panel includes a cut-out portion at about a top edge thereof adjacent a junction with said cover when said cover is in the closed position, said cut-out configured for traversing a portion of said flexible hose therethrough to take-up and pay-out said hose with said cover in the closed position.

22. The hose winding apparatus in accordance with claim 19 wherein said left and right side panels each include a pair of contoured support posts extending along the front and back ends thereof and integral with said panels, said support posts having elongated channels formed therein, and wherein said front and rear panels include elongated fittings extending from ends thereof and integral therewith, the fittings being adapted to insert into the support post elongated channels for securing to the left and right panels.

23. The hose winding apparatus in accordance with claim 19 wherein said left and right side panels each include at least one rubber pad fixedly secured to a bottom surface of each of said left and right side panels for engaging a surface to resist skidding of said hose winding device during operation.

24. The hose winding apparatus in accordance with claim 19, wherein said cover includes a depending lip and wherein said pins extend from said depending lip.

25. The hose winding apparatus in accordance with claim 24, wherein said pins are formed as fluted cylindrical elements extending from said depending lip, axially aligned with one another.

26. The hose winding apparatus in accordance with claim 24, wherein said cover further includes a releasable latch means for releasably holding said cover in a closed position.

27. The hose winding apparatus in accordance with claim 26, wherein said releasable latch means includes at least one catch, said at least one catch extending outwardly from said depending lip and cooperating with at least one detent, said at least one detent constructed and arranged to cooperate with said catch and incorporated into said side panels;

wherein said cover is opened by lifting the front portion of said cover upwardly, urging said catches past said detents.

28. The hose winding apparatus in accordance with claim 19, wherein said cover further includes at least one safety interlock for disabling said rotational means;

wherein motorized rewinding of said hose is locked out when said cover is in an open position, and motorized rewinding of said hose is operable when said cover is in the closed position.

29. The hose winding apparatus in accordance with claim 28, wherein said safety interlock includes a switching means, said switching means constructed and arranged to cooperate with said cover of said enclosure.

30. The hose winding apparatus in accordance with claim 29, wherein said switching means includes at least one electrical switch, said electrical switch operable by said cover to disconnect said power source from said direct current motor when said cover is in the open position.

31. The hose winding apparatus in accordance with claim 19, wherein said front panel of said enclosure further includes an elongated cut-out portion at about a bottom edge thereof extending upwardly, said cut-out configured for accommodating a drawer, said drawer configured to open in a pivotal fashion.

32. The hose winding apparatus in accordance with claim 19, wherein said right side wall panel of said enclosure further includes a foot pedal housing, said foot pedal housing constructed and arranged to prevent inadvertent operation of said foot pedal.

33. The hose winding apparatus in accordance with claim 32, wherein said foot pedal housing is recessed inwardly into said side wall panel.

34. The hose winding apparatus in accordance with claim 19, wherein said right side wall panel of said enclosure further includes at least one solar cell for recharging said direct current energized power assist means.

35. The hose winding apparatus in accordance with claim 19, wherein said rear wall panel further includes at least one recessed anchoring aperture, said at least one recessed anchoring aperture configured and arranged to anchor said enclosure to a surface or a suitable structure;

whereby unwanted movement of said enclosure is prevented.

36. The hose winding apparatus in accordance with claim 35, wherein said rear wall panel contains two said recessed anchoring apertures.

37. The hose winding apparatus in accordance with claim 19, wherein said enclosure further includes a bottom panel, said bottom panel having a first side and a second side, said bottom panel extending substantially between said left, right, front, and rear wall panels.

38. The hose winding apparatus in accordance with claim 37, wherein said bottom panel is reversible, said first side having a surface constructed for enhanced frictional engagement and said second side having a relatively smooth surface.

39. The hose winding apparatus in accordance with claim 1, wherein said hose winding apparatus further includes a manual override means, said manual override means constructed and arranged to provide manual rotation of said reel when said infinitely adjustable torque transfer assembly is decoupled from said reel.

40. The hose winding apparatus in accordance with claim 39, wherein said manual override means includes a crank releasably insertable through one of said enclosure side wall panels providing a direct coupling to said reel allowing rotation thereof, said reel including a handle connected to said crank, said handle having a releasable lock, said releasable lock securing said handle in a parallel position with said crank and securing said handle in a perpendicular position to said crank, said handle movable between said positions when said lock is released.

41. The hose winding apparatus in accordance with claim 40, wherein said crank has a resilient locking tab carrying a pawl and said handle has locking detents cooperating with said pawl to lock said handle in said parallel position and said perpendicular position.

42. The hose winding apparatus in accordance with claim 41, wherein said locking tab is connected to said crank by a living hinge.

43. The hose winding apparatus in accordance with claim 1, wherein said hose winding apparatus further includes a hose winding guide comprising:

a double helix lead screw, said double helix lead screw substantially parallel to and spaced apart from said reel axis of rotation and suitably supported and journaled in said left and said right side wall panels;

a guide rod substantially parallel to said reel axis of rotation, suitably supported by said left and said right side wall panels;

a carriage, said carriage constructed and arranged to cooperate with said double helix lead screw and said guide rod; and a hose guide gear-train, said gear train constructed and arranged to transfer rotary motion from said reel to said double helix lead-screw;

wherein said carriage reciprocates back and forth across said lead screw and said guide rod when said reel is rotated to uniformly and smoothly wrap said hose on said reel for a compact storage configuration.

44. The hose winding apparatus in accordance with claim 43, wherein said carriage includes a follower assembly, said follower assembly constructed and arranged to cooperatively engage said lead-screw.

45. The hose winding apparatus in accordance with claim 44, wherein said follower assembly is manually disengageable from said lead-screw and manually re-engageable to said lead-screw;

wherein said hose can be manually pulled from said reel without reciprocation of said hose winding guide and said hose winding guide is repositionable and re-engageable to said lead-screw.

46. The hose winding apparatus in accordance with claim 45, wherein said follower assembly is constructed and arranged for automatic disengagement;

wherein said follower assembly disengages said lead-screw thereby preventing said carriage from traversing said lead-screw in the event said carriage path becomes obstructed.

47. The hose winding apparatus in accordance with claim 43, wherein said hose guide gear-train includes:

a reel gear, said reel gear secured to said hub of said reel, said reel suitably journaled in said enclosure to allow rotational movement of said reel;

a driven gear, said driven gear suitably attached to said lead-screw of said hose winding guide assembly;

at least one idler gear, said at least one idler gear rotationally secured within said enclosure and intermeshing with said drive gear and said reel gear;

wherein said reel gear provides rotation of said at least one idler gear and said at least one idler gear provides rotation of said driven gear and said lead-screw secured thereto.

* * * * *